United States Patent [19]

Remner et al.

[11] 4,037,453

[45] July 26, 1977

[54] SHELL PUSHER FOR PLUG MILL OR THE LIKE

[75] Inventors: Robert A. Remner, Sewickley; Leroy V. Rowland, Evans City, both of Pa.

[73] Assignee: Aetna-Standard Engineering Company, Ellwood City, Pa.

[21] Appl. No.: 682,917

[22] Filed: May 4, 1976 (Under 37 CFR 1.47)

[51] Int. Cl.[2] ..... B21B 39/06

[52] U.S. Cl. ..... 72/252; 72/209

[58] Field of Search ..... 72/252, 209, 97, 208, 72/250, 214

[56] References Cited

U.S. PATENT DOCUMENTS

| | | | |
|---|---|---|---|
| 2,783,666 | 3/1957 | McLay | 72/252 X |
| 3,277,687 | 10/1966 | Kelly | 72/209 |
| 3,659,446 | 5/1972 | Gerretz | 72/250 X |

*Primary Examiner*—Milton S. Mehr

*Attorney, Agent, or Firm*—Mandeville and Schweitzer

[57] ABSTRACT

The disclosure relates to a novel and improved arrangement of shell pusher for feeding tubular shells into a plug mill. The pusher comprises a ram carriage, which is movably positioned on an elongated carriage track on the upstream side of the plug mill. The ram stroke capacity of the carriage is designed to be relatively minimum, sufficient to advance a shell from a predetermined load position, directly in front of the mill, until the leading edge of the shell is drivingly engaged by the working rolls of the mill. Means in the form of a heavy, elongated rack and pinion arrangement are provided for pre-positioning the ram carriage in advance of each loading operation of a new shell and also in advance of the return of that shell from the downstream side to the upstream side of the mill after each pass. By designing the ram carriage for minimum stroke capacity, the carriage and its ram may be of minimum size and mass, such that the working strokes of the pusher ram may be carried out at a high rate of speed in relation to the size of the equipment and the power requirements of the drive systems therefor. The ram carriage incorporates a hydraulic shock absorber system, which is arranged to controllably decelerate, and dissipate the kinetic energy of, a tubular shell being returned at high speed from the downstream side of the plug mill after a working pass. This enables the shell return operation to be carried out at increased speeds while avoiding excessive distortion of the upstream end of the tube shell, which might otherwise result from high speed impact of the shell against the ram head of the pusher.

16 Claims, 11 Drawing Figures

SHELL PUSHER FOR PLUG MILL OR THE LIKE

BACKGROUND AND SUMMARY OF THE INVENTION

In the production of seamless tubing, one of the intermediate operations involves passing of a pierced tubular shell through a plug mill to enlarge the internal diameter of the shell, reduce its wall thickness and increase its length. In a typical plug mill operation, a pre-heated tubular shell is delivered to a feeding trough on the upstream side of the plug mill and advanced by a suitable pusher arrangement until the leading edge of the shell is engaged by the working rolls of the mill. The shell is then drawn by the working rolls over a mandrel, which carries a plug of appropriate dimensions at its upstream end. Typically, two passes through the plug mill are required. Thus, after the shell has passed once through the mill, the mill rolls are opened slightly and the shell is engaged by return rolls and directed back through the mill, in a non-working pass. At some point, the shell is rotated 90° and then directed through a second working pass of the mill. Prior to the return or non-working pass, the original mandrel plug is caused or permitted to fall away from the pass line; a new plug is installed on the mandrel in advance of the next working pass.

As will be appreciated, when a shell is returned to the upstream side of the mill for a second working pass, it returns at greater length than when initially delivered to the mill as a result of elongation during working. Likewise, when the shell is returned after the second pass, it has been elongated still further. In conventional plug mill systems, this elongation is accommodated by positioning the shell pusher apparatus in such manner that, with the pusher ram retracted, the elongated shell, after the second pass, can be accommodated between the retracted ram and a predetermined load position in front of the mill. However, this requires that the ram be designed with a stroke capacity sufficient to push an unworked blank into the mill while at the same time being able to accommodate on the return a blank which has been elongated by as much as, say 30%. While such an arrangement can serve to perform the intended functions, the necessarily large stroke capacity of the pusher ram results in the movable mechanisms being quite heavy and correspondingly relatively slow operating.

With conventional shell pushing systems, the problem of accommodating shell length variation is compounded by the fact that there may be significant overall length variation in the incoming pierced shells. Accordingly, the pusher system must be adaptable to accommodate not only variations in shell length resulting from elongation during the working passes, but it also must accommodate the entire range of the shortest shell, prior to elongation, to the longest shell after elongation. In a typical mill, this can be an extreme variation from, say, 3,800 mm minimum incoming shell length to, for example, 18,000 mm length in the maximum length shell after elongation.

In view of the impracticability of constructing a shell pusher ram of adequate length to accommodate the entire range of sizes, from the shortest unworked shell to the longest shell after elongation, it has been proposed in the past to locate the ram cylinder at the most remote position from the mill, to accommodate the shell of greatest length after elongation. Attachments are provided, which can be selectively installed on the forward end of the ram, in order to accommodate workpieces of shorter length. Among the disadvantages of this arrangement are that, when working with shells of short length, the moving parts of the ram, including the extensions, combine to constitute an extremely large mass, which is difficult to move rapidly with a ram of reasonable power capacity. In addition, the use of ram extensions still requires the ram to have an operation stroke which is excessively long, in relation to the requirements of the present invention, because there is no opportunity to change ram extensions during the working pass of a shell, so that the ram capacity has to accommodate both the initial and elongated length of a shell.

In accordance with the present invention, an improved form of shell pusher apparatus is provided, which enables the working stroke of the pusher ram to be maintained at a practical minimum, sufficient merely to advance a shell from its load position into working engagement with the mill. In conjunction with the foregoing, the minimum stroke pusher ram is mounted on a movable ram carriage which can be quickly re-positioned, not only to accommodate shells of different original length, but also to accommodate the elongation of a shell during a working pass. Thus, after initially pushing a shell into the mill, the short stroke ram is retracted, and the ram carriage is bodily moved back to a new position to accommodate the anticipated elongation of the shell. When the shell is returned to the upstream side of the mill, either for a second pass or to be discharged, the ram carriage is in an appropriate position to accommodate the then greater length of the shell. Likewise, when a shell has completed its final pass, and has been returned to the upstream side of the mill and discharged, the ram carriage can be quickly re-positioned at a location appropriate to the length of the next-loaded, unworked tubular shell.

In a most advantageous form, the shell pusher ram arrangement incorporates a hydraulic absorbing system, which becomes operative near the retraction limit of the shell pusher ram. This enables the ram head to serve effectively as an energy absorbing abutment stop for tubular shells being returned in the upstream direction after a working pass. In this respect, consistent with the overall objective of increasing the speed and efficiency of operation of the plug mill, it is desired that tubular shells be returned as rapidly as practicable after completion of a working pass. By utilizing the pusher ram to absorb the kinetic energy of the returning shell, higher return speed may be accommodated with damage to the end of the shell.

High speed re-positioning of the ram carriage is achieved most advantageously by an elongated rack structure, which cooperates with a heavy-duty, electrically driven pinion arrangement. In advance of each shell pushing operation, and also in advance of the return of a shell after a working pass, the drive motor is controllably energized to re-position the ram carriage at high speed. When the ram is properly positioned, the rack and pinion mechanism is locked, so that the pusher ram is firmly anchored in its appropriate location.

For a better understanding of the above and other features and advantages of the invention, reference should be made to the following detailed description of a preferred embodiment and to the accompanying drawings.

DESCRIPTION OF A PREFERRED EMBODIMENT

Figure 1:
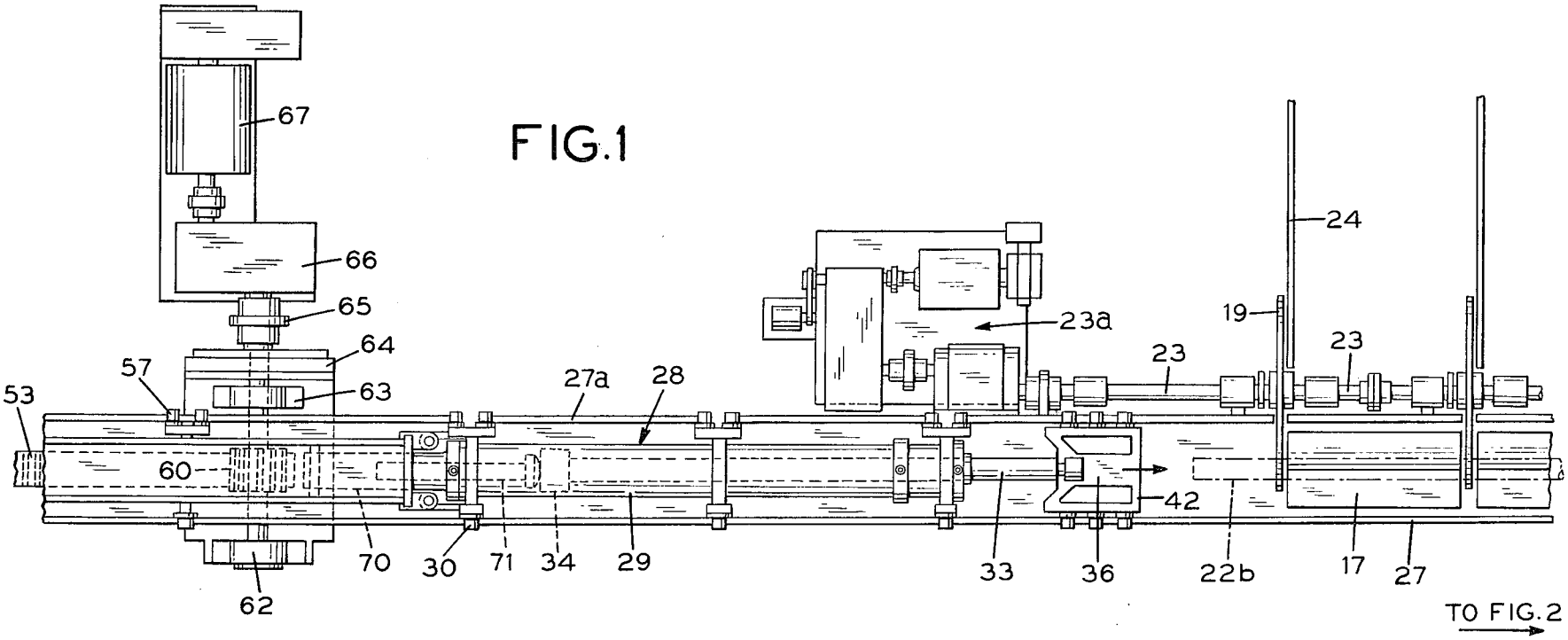
FIGS. 1 and 2, taken together, constitute a top plan view of the feed section of a plug mill provided, in accordance with the invention, with a re-positioned ram carriage for feeding shells into the working pass of the mill.

Referring now to the drawings, and initially to FIGS. 1–4 thereof, the reference numeral 10 (FIG. 4) designates in general a plug mill installation having working rolls 11 and shell return rolls 12. The working principles of a plug mill are well known and form no part of the present invention. By way of background only, it will be noted that a pre-heated tubular shell is initially pushed from the upstream side (left in FIG. 4) into the working rolls 11 and is thereupon drawn through the mill, between the working rolls and a mandrel plug (not shown). This operation serves to enlarge the diameter and reduce the wall thickness of the tube. After the tube has completed its working pass and is discharged on the downstream side of the rolls 11, the working rolls are opened slightly and the tube is engaged by return rolls 12, which send the tubular shell back to the upstream side of the mill. Typically, the shell is given a second pass through the plug mill, after having been rotated 90° from its original orientation. A new mandrel plug is put in place prior to each pass and for this purpose the mill installation may advantageously include a plug chamber mechanism 13 of a type described and claimed in the copending application of Russel E. Jones, Ser. No. 682,920, filed May 4, 1976, assigned to Aetna-Standard Engineering Co. of Ellwood City, Penn., a subsidiary of White Consolidated Industries, Inc.

Figure 9:
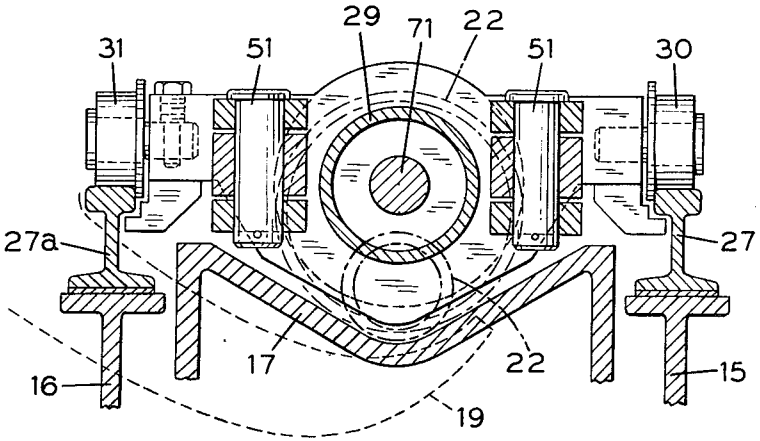
FIG. 9 is a cross sectional view as taken generally on line 9—9 of FIG. 7.

Extending upstream from the plug mill 10 is a feed table 14, which receives tubular shells and guides and supports the shells in their movements to and from the plug mill 10. The feed table 14 may comprise a pair of foundation beams 15, 16, which extend upstream from the mill a sufficient distance to accommodate the longest tubular shell after elongation. Supported between the foundation beams is a guide trough structure 17, of a shallow V-shaped configuration (see FIG. 9), which serves as an elongated guide trough for the tubular shells. The trough structure is segmented, to receive support rollers 18, between certain segments, and star wheel kick-out elements 19, between other segments.

Tubular shells are supplied to the feed table 14 from a feed rack (not shown) provided with feed kick-out elements 20 alongside the table. The kick-out elements 20 are operated by a common shaft 21 and, when the shaft is rotated through 90° or so serve to lift a tubular shell 22 off of the rack and cause it to roll into position in the center of the V-shaped trough structure 17. Removal of the shell, after working in the mill, is effected by means of indexable star wheels 19. The star wheels, which are of conventional construction, are formed with shell-receiving pockets, normally aligned with the shell and permitting free longitudinal movement of the shell and the shell pushing means. For removal of the shell, the star wheels 19 are rotated in unison by a shaft 23 and drive **23*a*, lifting the shell off of the trough structure 17 and carrying it around to an inclined discharge rack 24**.

Figure 2:
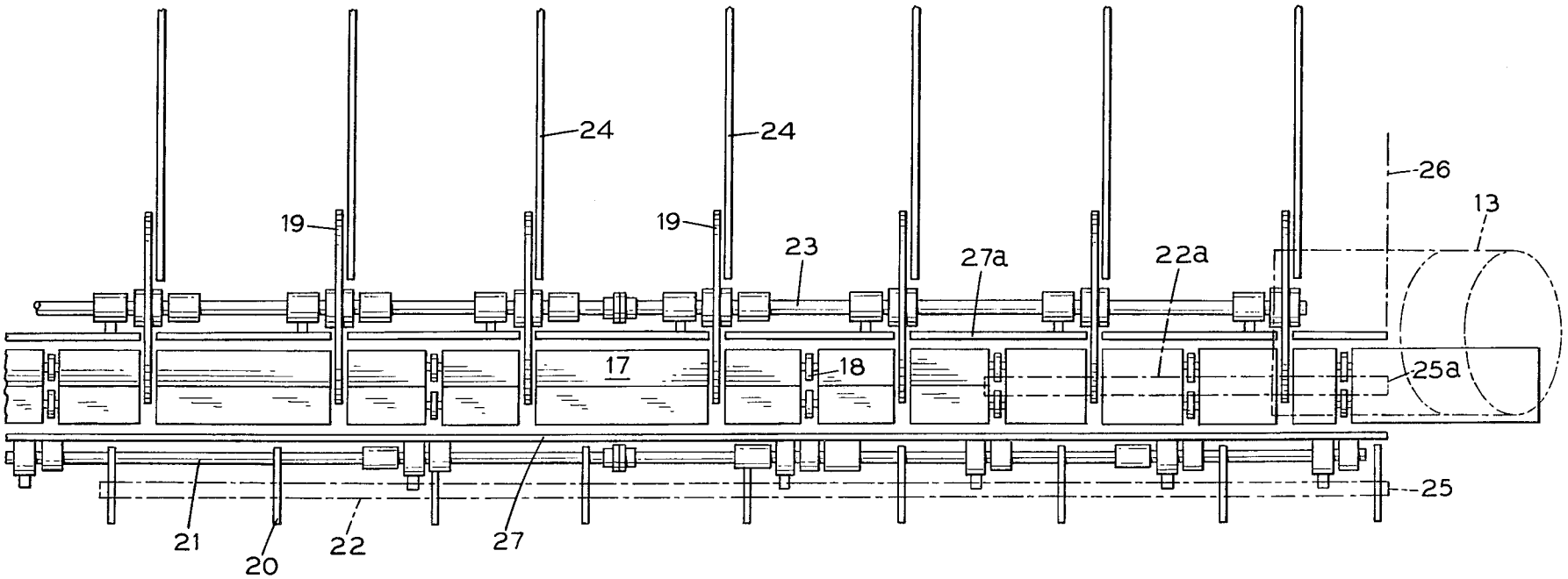
Figure 3:
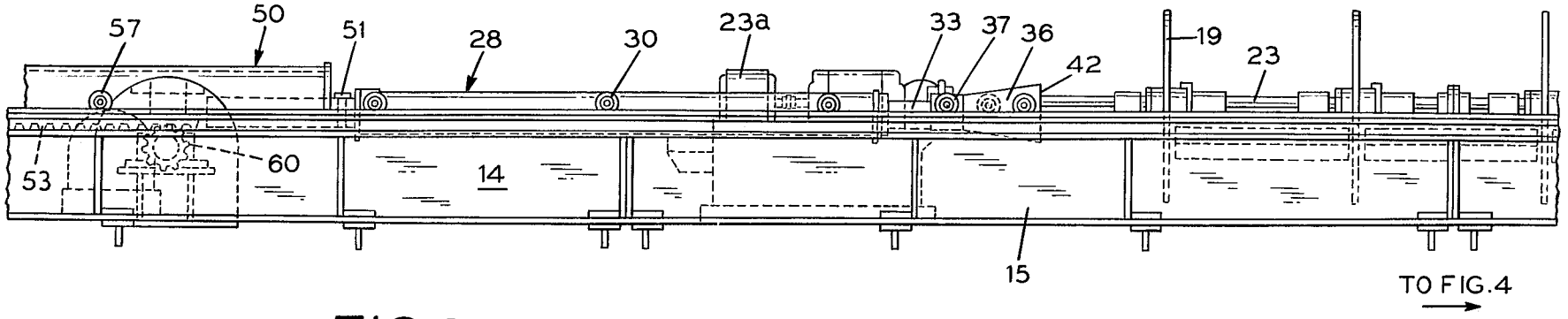
FIGS. 3 and 4, taken together, constitute a front elevational view of the apertures of FIGS. 1 and 2.
Figure 4:
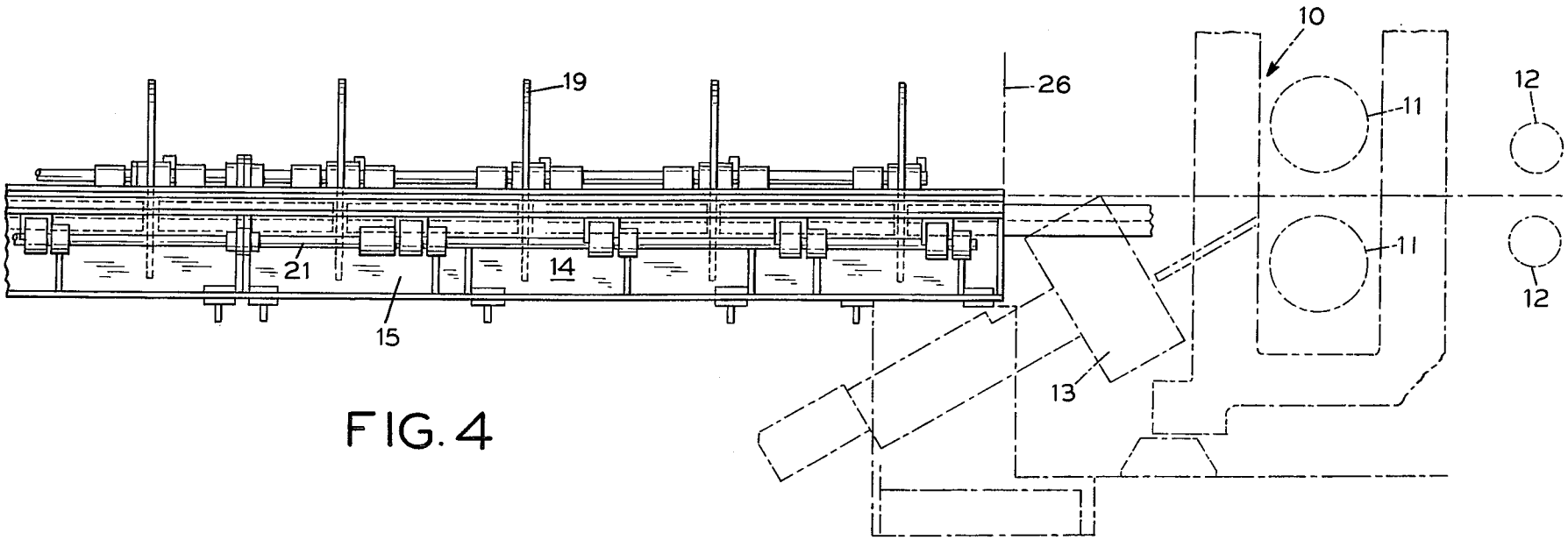

At **22*a*, in FIG. 2, there is shown a tubular shell in a loaded position, supported by the trough structure 17. The shell 22*a* is generally illustrative of the length of the minimum length unworked shell which, in the representative apparatus, illustrated herein, is around 3,800 mm. The shell 22 is representative of the maximum unworked shell length which, in the contemplated apparatus, may be around 13,000 mm, while 22*b* (FIG. 1) reflects the length of the maximum length shell after elongation by working in the plug mill. The overall trough structure, and the star wheel discharge structure is of course designed to accommodate the elongated, maximum length shell 22*b***, which may have a length on the order of 18,000 mm in the representative system.

Regardless of the length of the unworked shell, it is arranged on the inlet table such that its leading end **25, 25*a* is substantially aligned with a predetermined clearance plane 26 in front of the plug mill. When thus aligned, the tubular shell will be considered, for the purpose of this description, to be in a predetermined load position. In a typical mill installation, there is a finite distance between the clearance plane 26 and the bight of the working rolls 11. In a representative mill installation this distance, which may be referred to for convenience as the clearance distance, may be on the order of 3,000 mm. Accordingly, in order to feed any shell, stationed at the predetermined load position, into the mill, it is necessary to push that shell for at least the 3,000 mm clearance distance. In accordance with the invention, the pusher apparatus has a capacity which equals but does not excessively exceed the clearance amount. Thus, in the illustrated example, where the clearance distance is 3,000 mm. it may be appropriate to provide for a pusher ram stroke, overall, of around 4,000 mm, to accommodate some tolerance in the initial positioning of the shell and also to provide for a limited follow through the pusher to assure that the shell is properly entered into and fully engaged by the mill rolls 11**. Pursuant to the invention, however, a pusher ram of the minimum capacity described serves for all shells, both long and short and in unworked and elongated form, by providing for the rapid re-positioning of the pusher ram between working passes of the mill.

Pursuant to the invention, the beams 15, 16 mount elongated carriage-supporting tracks **27, 27*a*, which support a ram carriage 28 for movement along the length of the feed table 14. The ram carriage 28 includes an elongated air cylinder 29, which is supported on the inloading side by a plurality of spaced wheels 30, engaging the track 27, and is supported on the outloading side by a plurality of pairs of wheels 31, supported on the track 27*a*. As reflected particularly in FIGS. 2 and 7, the track 27*a* on the outloading side is required to be segmented, to accommodate the presence of the star wheels 19. The wheels 31, being arranged in closely spaced pairs, serve to bridge the gaps 32 between adjacent segments of the rail 27*a***.

The ram carraige 28 mounts a ram 33, which is connected internally to piston 34. The ram extends forwardly from the head end 35 of the cylinder and mounts a heavy-duty pusher head 36. The pusher head, like the cylinder 29, is mounted on spaced wheels 37, 38, with an extra wheels 38 being provided on the outloading side for bridging over the rail gaps 32.

Figure 7:
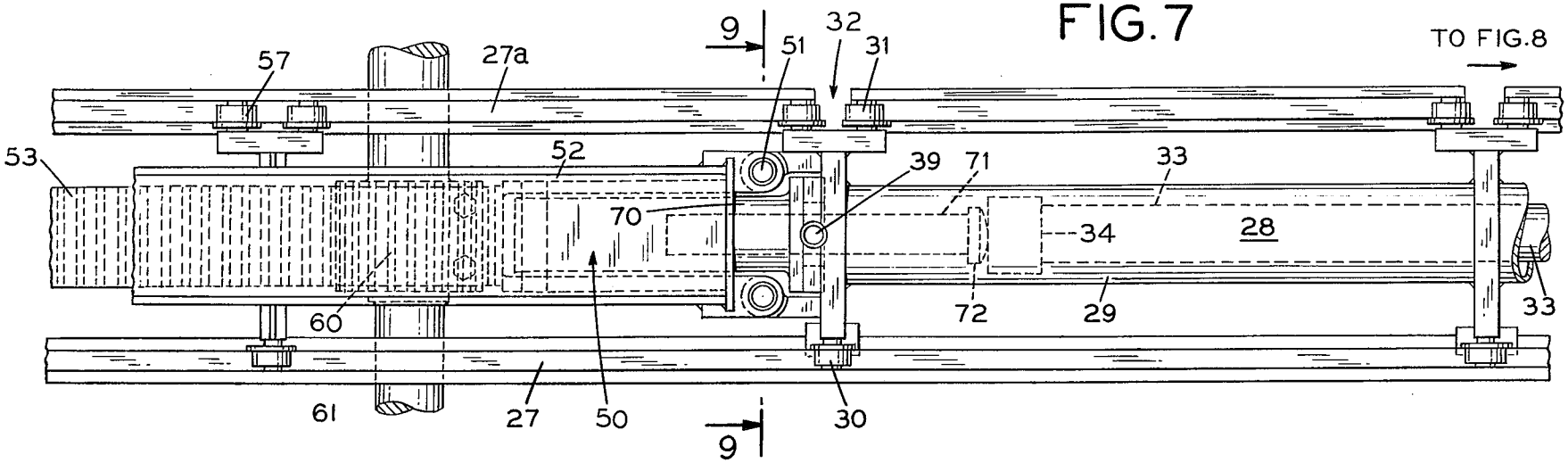
FIGS. 7 and 8, taken together, constitute a top plan view of the ram carriage of FIGS. 5 and 6.
Figure 8:
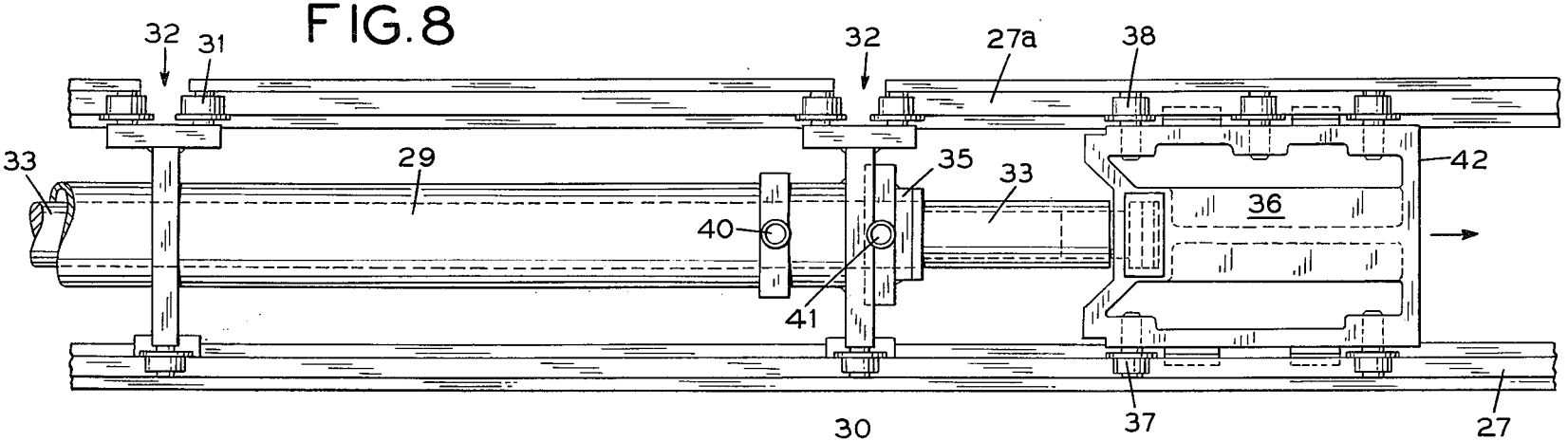
Figure 10:
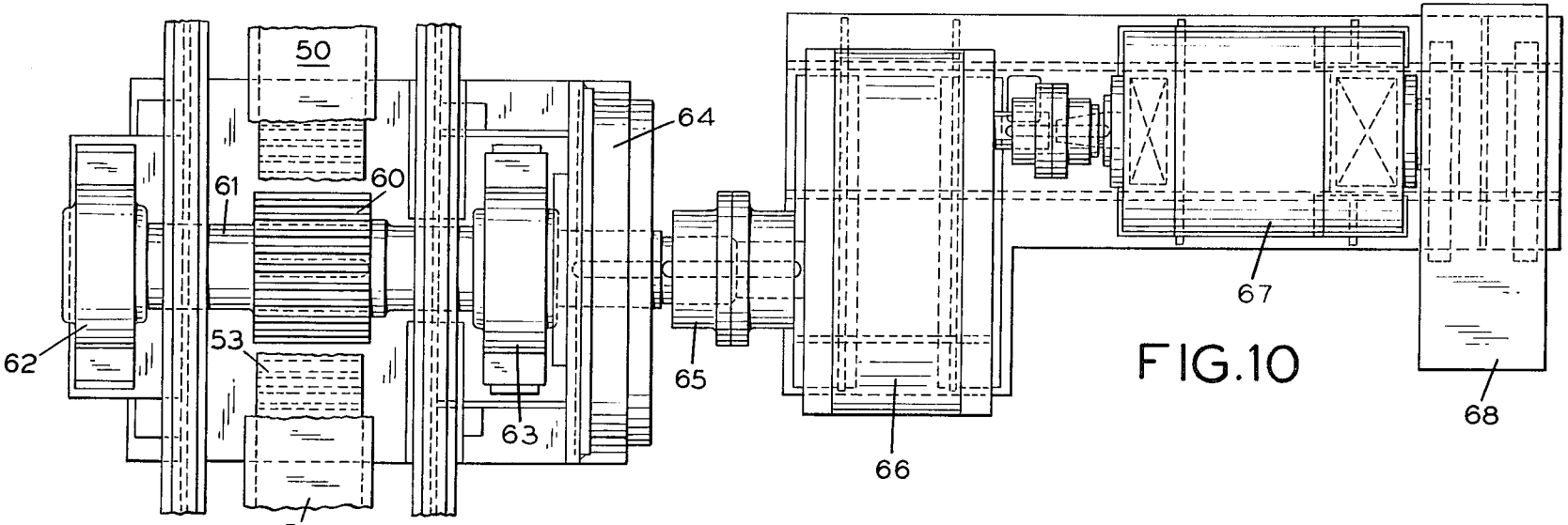
FIGS. 10 and 11 are top plan and side elevational views respectively of the drive system for re-positioning of the ram carriage.

As reflected in FIGS. 7 and 8, the air cylinder 29 has an inlet port 39 at its piston end, and a pair of spaced ports 40, 41 at its rod end. When air under pressure is admitted to the port 39, the piston 34 and ram 33 are driven forwardly, to extend the pusher head 36. As will be more fully described, the front face 42 of the pusher head is positioned initially adjacent the upstream end of a tubular shell, such that the forward motion of the pusher head 36 serves to advance the shell into the plug mill 10 in the desired manner. The normal exhaust port for the cylinder is the port 40, which is spaced somewhat from the extreme end of the cylinder. When the piston 34 reaches the port 40, the latter is closed off, trapping a certain amount of air in the end extremity of the cylinder. This trapped air is permitted to bleed controllably out of the port 41, for controlled deceleration of the ram near the forward extremity of its stroke. As previously mentioned, the total operating stroke of the ram 33 is not excessively greater than the clearance distance provided by the mill. In the illustrated example, an overall ram stroke of 4,000 mm is suitable for a clearance distance of around 3,000 mm, taking into account typical working tolerances in a mill of this nature.

Figure 5:
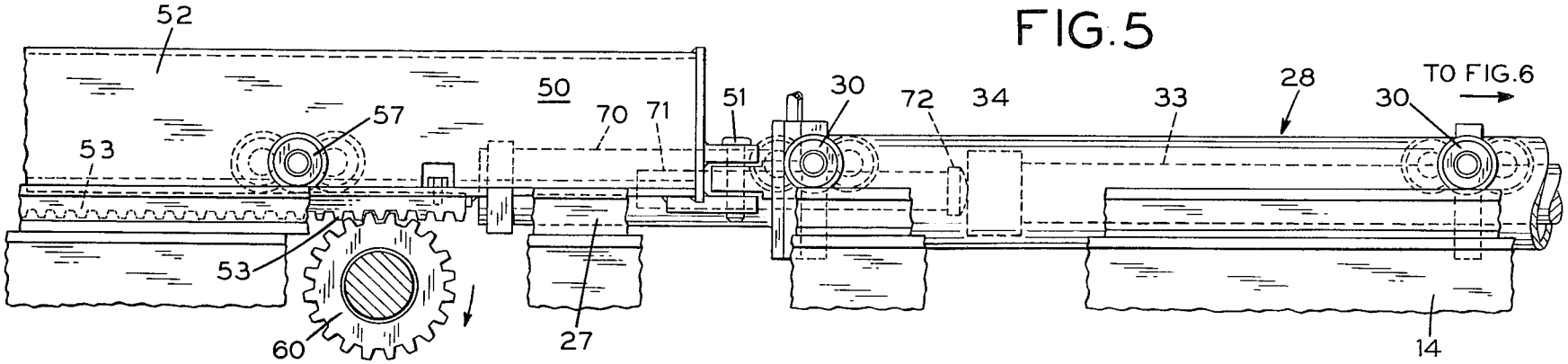
FIGS. 5 and 6, taken together, constitute a side elevational view showing details of the ram carriage arrangement according to the invention, as well as some details of the rack and pinion drive therefor.
Figure 6:
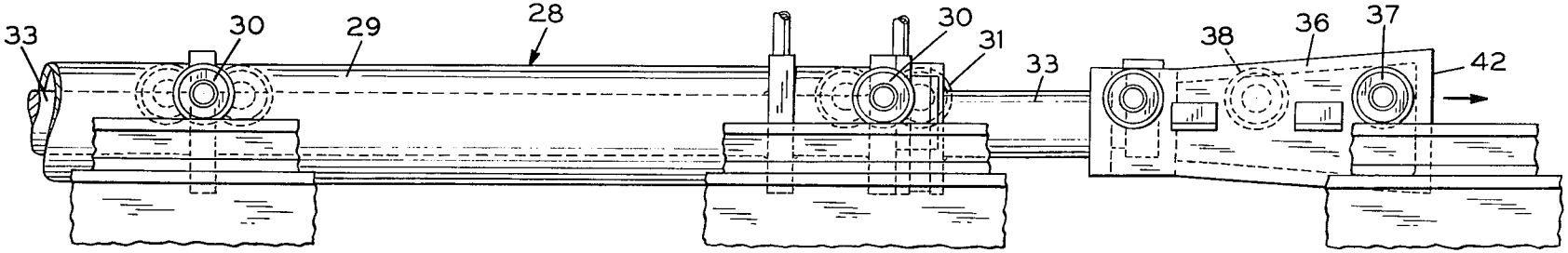

Pursuant to the invention, the ram carriage 28 is mounted for controlled movement and positioning along the tracks **27, 27*a* by means of a track-supported rack and pinion assembly. As shown in FIGS. 5 and 7, for example, a highly elongated rack structure 50 is connected at its forward end to the ram carriage 28, by means of heavy connecting pins 51. The rack structure itself comprises an elongated, tunnel-like housing 52, to the bottom of which is bolted or otherwise secured an elongated, heavy-duty rack 53. In accordance with the invention, the rack 53 is required to have sufficient overall length to move the ram carriage 28 from a forward limit position, appropriate for the shortest unworked tubular shell 22*a*, to be a retracted limit position, appropriate to the length of the longest tubular shell 22*b*, after elongation by two or more passes through the plug mill. In the representative mill, an overall carriage travel capability of about 14,200 mm is provided for, with the length of the rack being slightly longer than the maximum excursion of the carriage. Since it is contemplated that the rack 53 will be driven at relatively high speeds and will support substantial loads in compression, the rack is not only supported by its own set of tracks 27, 27*a*, but is also significantly strengthened and rigidified by the housing 52**, which is of hollow construction and of substantial cross section in relation to that of the rack itself.

Figure 11:
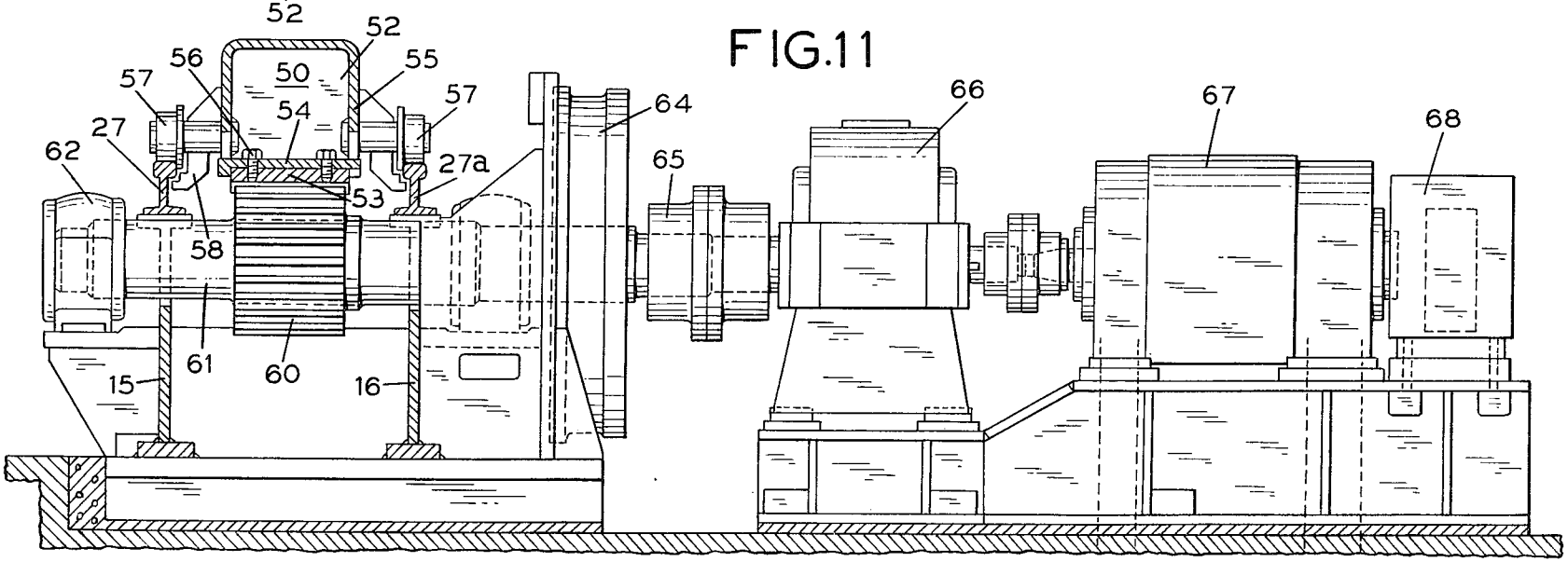

Thus, with reference to FIG. 11, the rack housing 52 includes a flat base plate 54, which is welded or otherwise secured to a backbone section 55 of inverted U-shaped configuration. The housing 52 extends the full length of the rack 53, and is secured thereto by suitable means such as bolts 56. At suitable locations along the length of the rack housing 52 (e.g., about every 2500 mm or so), there are provided supporting wheels 57, which support the rack assembly on the tracks **27, 27*a*. In this region, the track 27*a* on the outloading side need not be segmented. Nevertheless, at least the forward wheel sets on the outloading sides of the rack housing will be arranged in pairs, as these forward sets will at times be advanced onto segmented sections of the track. Desirably, retaining arms 58 are secured to the rack housing and extend underneath the head flanges of the rails 27, 27*a* to insure the retention of the flanged wheels 57 on the rails. If necessary, additional sets of retaining wheels (not shown) could be provided in place of the retaining arms 58**.

In the illustrated system, the rack 53 is driven by means of a heavy pinion 60 mounted on a shaft 61 journaled on opposite sides of the tracks by bearings 62, 63. The inboard end of the shaft 62 is connected to a heavy-duty locking brake 64, which is sufficiently strong to lock the shaft 61 and pinion 60 against rotation during normal operation of the ram carriage 28. The shaft 61, on the "upstream" side of the brake 64 connects through a coupling 65 to a gear reducer 66 and to an electric drive motor 67. In the representative mill of the disclosure, the drive motor 67 may be DC mill motor of around 150 horsepower, adequate to rapidly accelerate and decelerate the mass of the rack assembly 50 and the ram carriage 28. Desirably, the motor 67 will have its own control brake 68 for controlling deceleration of the motor. However, locking of the pinion during operation of the ram carriage 28 is advantageously effected by the heavy-duty brake 64, which is downstream of both the drive motor 67 and the gear reducer 66, so that these elements are effectively isolated from the loading of the ram carriage in operation.

To great advantage and as one of the specific features of the invention, the ram carriage 28 incorporates, at its base or piston end, a hydraulic shock absorber arrangement to absorb impact and dissipate energy from shells being returned in the upstream direction at the completion of a mill pass. In the illustrated arrangement, the shock absorber includes a fluid cylinder 70, which may be secured directly to the base of the air cylinder 29. The hydraulic cylinder has a plunger 71, one end of which extends into the cylinder casing 70 and the other end of which extends forward into the base end of the ram cylinder 29. The head end 72 of the shock absorber ram is arranged to contact the face of the piston 34, when the ram 33 is in a "normal" retracted position, substantially as indicated in FIG. 7. In its normal retracted position, the piston 34 is spaced substantially forward of its absolute bottom. In the representative mill installation, a spacing of around 600 mm is provided, such that a shock absorbing movement of around 600 mm can be accommodated from the normal fully retracted position of the pusher ram 33. The plunger 71 in its normal position will be extended forward into contact with the face of the piston 34.

Although the specific workings of the shock absorber cylinder 70 are not critical, and the principles thereof are well known and understood, it is contemplated that the cylinder will communicate through one or more restricted orifices with a suitable hydraulic accumulator (not shown). Thus, when the plunger 71 is driven into its cylinder 70, fluid will be displaced from the cylinder and forced through the restricted orifices into the accumulator, with an accompanying coversion of energy into heat. The plunger 71 eventually is returned to its normal or projected position by the stored energy of the accumulator, for example. A fluid bypass may be provided for re-admitting fluid into the cylinder 70 without passing through the restricted orifice means, all in accordance with well known concepts.

In the operation of the equipment of the invention, a tubular shell of any size, within the maximum to minimum range effected by the shell 22, 22*a* in FIG. 2, is delivered from the heating furnace to the feeding trough 17, by the kicker arms 20. Either by operator observation or, more typically, by pre-programmed automatic control, the drive motor 67 has previously been actuated to move the ram carriage 28 along the tracks 27, 27*a* to a position in which the ram head 36, in its normal retracted position, will be located closely adjacent to the upstream end of the tubular shell. In the representative mill described, the initial spacing normally would not exceed around 500 mm. With the ram carriage thus positioned, the rack assembly 50 is locked into position by the heavy-duty pinion brake 64, and the shell can then be advanced into the plug mill by admission of air into the piston end of the ram cylinder 29. With a full 4,000 mm extension of the pusher ram 33, the initial spacing is taken up and the shell is advanced through the initial clearance distance of around 3,000 mm, until the shell is engaged by the plug mill and drawn through by action of the mill rolls themselves, independent of the pusher carriage.

As soon as the shell has been engaged by and is under control of the mill rolls 11, the pusher ram 33 is retracted to its normal retracted position. At the same time, the pinion locking brake 64 is released and the drive motor 67 is operated to retract the ram carriage 28 to a new predetermined position. The hydraulic and air valving is so controlled that the ram is effectively locked in its normal position, against the head of the extended plunger 71, during movements of the ram carriage 28. The new position of the ram carriage can be pre-programmed into the mill control or performed manually, preferably the former. In either case, the ram carriage is moved directly back to a precalculated position which will locate the front face of the pusher head 36 at a position appropriate to accommodate the shell after elongation in the mill. The extend of the elongation can, of course, be ascertained empirically or by calculation, but in any event is known prior to the commencement of the plug mill operation, so that the ram carriage is moved directly to the new position and is ready to receive the elongated shell.

After the shell has passed through the plug mill in a downstream or working direction, the mill rolls 11 are slightly opened and pinch rolls 12 are brought into contact with the shell and are driven at relatively high speed to rapidly return the now elongated shell back to the upstream side of the mill.

Pursuant to the invention, the shell-returning pinch rolls 12 can be arranged to return the shell at speeds substantially above conventional. In this respect, return speeds of around 11 m per second could be considered representative. As will be readily understood, a tubular shell, weighing perhaps in excess of 5,000 pounds and traveling at a speed of 11 m per second has substantial kinetic energy which must be absorbed to bring the shell to a stop. Since the shell at this stage is hot (e.g., 670° C) and relatively soft, the end of the tube is susceptible to damage by excessive impact forces. With the apparatus of the present invention, when the returning shell strikes the front face of the pusher head, the ram 33 is moved in an upstream direction, against the progressively increasing force of air trapped in the piston end of the cylinder 29 and against the resistance of the hydraulic shock absorber 70. In the representative mill described, the neutral or normal retracted position of the ram 33 is such as to provide for about 600 mm of additional ram retraction upon impact by the returning shell. Thus, the kinetic energy of the shell is gradually dissipated by retraction of the ram against a resistance, with the energy of the shell being dissipated in the form of heat developed by the shock absorber 70. This enables the impact forces on the end of the hot shell to be maintained low enough to avoid excessively damaging the end of the shell, while at the same time enabling the shell return operation to be carried out at significantly greater speeds.

After the shell has been decelerated to a stop, the ram returns to its normal position and a new pushing operation may be commenced, pushing the now elongated shell back into the plug mill for its second pass.

While the shell is undergoing its second mill pass, the rack and pinion drive for the ram carriage is again actuated, repositioning the ram, so that the front face 42 of the pusher head, with the ram retracted to its normal position, will be located to accommodate the further increase in the length of the shell. The return of the shell after the second pass is substantially the same as above described, with the kinetic energy of the rapidly returned shell being absorbed by friction losses in the hydraulic absorber 70.

After its second pass, the shell is discharged by actuation of the drive system 23*a* for the star wheel shaft 23. This serves to lift the completed shell out of the supporting trough 17 and to deposit it on the inclined rack 24.

In a case where a succession of incoming shells is of equal length, the rack an pinion drive will be actuated after removal of a processed shell, to advance the ram carriage 28 forwardly to a position appropriate for the length of the incoming shell. If the next incoming shell is of greater length, of course, the ram carriage may have to be retracted. In any case, the length of the incoming, unprocessed shell may be pre-programmed into the mill control, along with the extent of elongation that the shell will experience in its first and second mill passes. Accordingly, control over the rack driving motor 67 may be such as to automatically position the ram carriage 28 properly to first receive the new shell, then to re-position the carriage to receive the shell returning from the first pass, and to again re-position the carriage to receive the shell returning from the second pass. By providing for a re-positioning of the ram carriage during each of mill passes, the necessary stroke capacity of the ram may be kept at an absolute minimum consistent with the necessary front clearance at the mill and the expected operating tolerances.

In the system of the present invention, length capacity is achieved, not by providing excessive initial length capacity and/or spacer attachments in the ram itself, but by providing a mechanism for rapidly re-positioning the ram at any location, and as often as necessary, to enable a ram of minimum length to function under all conditions. The use of a positioning drive mechanism for the ram carriage is a highly favorable trade off to providing for increased capacity in the pusher ram, and enables significant increases in mill efficiencies.

The provision of an energy dissipating shock absorber arrangement, in conjunction with the pusher ram has significant advantages in the context of the described apparatus. In one aspect, the energy absorbing arrangement enables the high temperature (and thus easily damaged) shells to be returned from the plug mill at much higher speeds than heretofore, without occasioning unnecessary impact damage to the end of the shell. In addition, the provision of an effective energy absorbing system, in conjunction with the ram, functions to isolate and reduce shock loading on the carriage re-positioning the system. In this respect, particularly in the case of relatively short shells, a substantial length of the rack assembly 50 will be under compression load when absorbing the impact of a returning shell. By effectively dissipating the impact energy over a substantial length of deceleration travel, the compression loading on the rack structure is minimized, and this in turn enables the weight of the structure to be kept at a minimum to facilitate high speed re-positioning. It will be further understood, in this respect, that the length of the rack structure which is in compression, for any given shell, is inversely proportional to the length of the shell itself. Thus, with longer shells, which will have greater mass and momentum, the unsupported length of rack structure in compression will be proportionately shorter and thus more able to withstand the load.

It should be understood, of course, that the specific form of invention herein illustrated and described is intended to be representative only, as certain changes may be made therein without departing from the clear teachings of the disclosure. Accordingly, reference should be made to the following appended claims in determining the full scope of the invention.

I claim:

1. For use in combination with a plug mill or the like having working rolls for engaging and working a tubular shell and means for returning the shell through the mill after a working pass, a shell pushing system, which comprises a. an elongated carriage track on the upstream side of the mill, b. a ram carriage movable on said carriage track, c. said ram carriage including a movable ram adapted for a working stroke of adequate length to advance a tubular shell from a predetermined load position into working engagement with the mill rolls but of inadequate length to advance the shell into such working engagement from a position significantly upstream of said load position, d. means for controllably positioning said carriage in advance of each shell loading operation to accommodate the incoming length of the shell and for re-positioning said carriage at a location more remote from the mill, in advance of the return of the shell, to accommodate the increased length of the shell, and e. energy dissipating means associated with the movable ram for decelerating and absorbing the kinetic energy of the returning shell.

2. The system of claim 1, further characterized by a. said means for controllably positioning the ram comprising an elongated rack structure connected to the ram carriage, and, b. a controllably driven pinion engaging said rack structure.

3. The system of claim 1, further characterized by a. a controllable drive for said pinion, including a drive motor and gear reducer, and b. a locking brake located in the drive train between said pinion and said gear reducer.

4. The system of claim 1, further characterized by a. said ram carriage including a fluid cylinder for operating said ram, b. said energy dissipating means comprising a hydraulic shock absorbing cylinder and plunger, c. said plunger being movable with said ram during extreme retracting movements of the ram.

5. The system of claim 4, further characterized by a. said plunger normally extending into said fluid cylinder from its upstream end and engageable with said ram at a substantial distance forward of said upstream end, b. said ram having a normal retracted position substantially where engaged by said extended plunger.

6. For use in combination with a plug mill or the like having working rolls for engaging and working a tubular shell and means for returning the shell through the mill after a working pass, a shell pushing system, which comprises a. a pusher cylinder and ram having a ram stroke of sufficient capacity to push an unworked shell from a predetermined load position into working engagement with the mill but of insufficient stroke capacity to push an unworked maximum length shell into working engagement with the mill from an initial ram position which is spaced far enough from the mill to accommodate the shell after elongation in the mill, b. means supporting said pusher cylinder for movement toward and away from the mill, and c. controllable drive means for advancing and retracting said pusher cylinder.

7. A system according to claim 6, further characterized by a. hydraulic energy dissipating means positioned effectively between said ram and said drive means for controllably decelerating a tubular shell being returned after a working pass through the mill.

8. A system according to claim 6, further characterized by a. a carriage mounting said cylinder and ram, b. said carriage being movable on wheels on said supporting means, c. controllable drive means including a rack and pinion drive for advancing and retracting said carriage, and d. means for locking said rack in predetermined position in advance of a shell pushing operation.

9. A system according to claim 8, further characterized by a. said drive means further including a drive motor and gear reduction drive for said pinion, and b. locking brake means being provided between said gear reduction drive and said pinion to lock said pinion.

10. A system according to claim 8, further characterized by a. the rack of said rack and pinion drive including an elongated, hollow housing-like structure, and b. a wheel and track arrangement for supporting said housing-like structure, and c. a rack member secured to and supported by said housing-like structure.

11. For use in combination with a plug mill or the like having working rolls for engaging and working a tubular shell and means for returning the shell through the mill after a working pass, a shell pushing system, which comprises a. a fluid cylinder and ram for engaging a shell and pushing it into initial working engagement with the plug mill, b. means for re-positioning the ram at a location appropriate to accommodate unrestricted return of the shell after elongation in the mill during the working pass, and c. hydraulic energy absorbing means associated with said ram to accommodate controlled retraction of said ram under resistance from the re-positioned appropriate ram location to controllably dissipate the kinetic energy of the shell moving in an upstream direction after the working pass.

12. A system according to claim 11, further characterized by a. said fluid cylinder and ram being air actuated, b. said hydraulic energy absorbing means comprising a hydraulic cylinder and plunger, c. said plunger being engageable with said ram when said ram is in a normally retracted position, d. said ram being further retractable, under resistance by said plunger, upon engagement of said ram by a tubular shell moving in a return direction.

13. The method of operation a mill feed system for a plug mill or the like, where the mill feed system includes a pusher cylinder ram, which comprises a. supplying a tubular shell in a predetermined load position in front of the mill, b. initially retracting the ram and so positioning the cylinder that the retracted ram is closely adjacent the upstream end of the shell prior to elongation, c. while maintaining the position of the cylinder, extending the ram through a limited stroke sufficiently to advance the shell into initial working engagement with the rolls of the plug mill, d. retracting the extended ram and re-positioning the cylinder at a new and retracted position to accommodate return from the mill, after elongation therein, of the tubular shell, whereby, when the returned elongated shell is in the predetermined load position, the retracted ram is closely adjacent the upstream end of the elongated shell, e. while maintaining the new position of the cylinder, again extending the ram through said limited stroke to advance the elongated shell into initial working engagement with the mill, and f. again retracting the extended ram and re-positioning the cylinder at a new and further retracted position to accommodate return from the mill, after a second elongation, of the tubular shell.

14. The method of claim 13, in which the cylinder is re-positioned after each of a plurality of working passes of a tubular shell through the mill.

15. The method of claim 13, further characterized by a. said ram is initially retracted to a position spaced significantly from the limit of maximum retraction, b. a shell being returned from the mill is progressively decelerated by further retraction under resistance of said ram beyond its initial retracted position.

16. The method of claim 15, further characterized by a. dissipating the kinetic energy of a moving, returned shell by displacing hydraulic fluid through restricted orifice means during and as a result of the further retraction of said ram.

* * * * *